US006381802B2

(12) United States Patent
Park

(10) Patent No.: US 6,381,802 B2
(45) Date of Patent: May 7, 2002

(54) BRUSH ASSEMBLY OF A VACUUM CLEANER

(75) Inventor: Jung-seon Park, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/737,296

(22) Filed: Dec. 13, 2000

(30) Foreign Application Priority Data

Apr. 24, 2000 (KR) ..... 00-21703

(51) Int. Cl.[7] ..... A47L 9/00
(52) U.S. Cl. ..... 15/325; 15/364
(58) Field of Search ..... 15/325, 364

(56) References Cited

U.S. PATENT DOCUMENTS 1,869,157 A * 7/1932 Lang ..... 15/325
4,198,727 A * 4/1980 Farmer ..... 15/364
4,219,902 A * 9/1980 DeMaagd ..... 15/364
4,797,968 A * 1/1989 Wenzlick et al. ..... 15/325

OTHER PUBLICATIONS

Combined Search and Examination Report issued Apr. 5, 2001 by the British Patent Office with respect to corresponding British Patent Application No. 0104873.5.

* cited by examiner

*Primary Examiner*—Robert J. Warden, Sr.
*Assistant Examiner*—Theresa T. Snider
(74) *Attorney, Agent, or Firm*—Ladas & Parry

(57) ABSTRACT

A brush assembly for a vacuum cleaner includes a brush cover; a brush base connected to the brush cover, a rotary drum disposed between the brush cover and the brush base, and an edge brush integrated bumper. The edge brush integrated bumper is mounted around a joint surface between the brush cover and the brush base. The edge brush integrated bumper includes a pair of edge brush portions integrally formed with the bumper. Each edge brush portion corresponds to a side of the brush cover and brushes off dust that is not accessible to the rotary drum. The brush assembly further includes assembling position guide means and fixing means for securing bumper to the brush cover. Since the bumper and edge brushes are integrally formed in an injection molding process, the number of separate parts to the brush assembly is reduced. Also, since the bumper and edge brushes can be assembled simultaneously, productivity is increased as assembly time is decreased.

12 Claims, 4 Drawing Sheets

BRUSH ASSEMBLY OF A VACUUM CLEANER

BACKGROUND OF THE INVENTION

1. Field of the Invention

The present invention relates to a vacuum cleaner and, more particularly, to a brush assembly for an upright type vacuum cleaner.

2. Description of the Related Art

Generally, as shown in FIG. 1, an upright type vacuum cleaner is formed by a combination of a cleaner body 2 having a handle portion 1 with which a user grips when cleaning, and a brush assembly 3 located on the lower portion of the cleaner body 2 for moving along the cleaning surface during the cleaning process.

The cleaner body 2 has a dust collecting chamber having a dust filter (not shown) located inside, and a motor driving chamber having a motor (not shown) for driving the loads of the vacuum cleaner. When the motor (not shown) is in operation, it generates a strong suction force at the brush assembly 3 to draw foreign substances on the cleaning surface, such as dust or dirt, along with air through the brush assembly 3 and into the dust collecting chamber of the cleaner body 2. Here, dust or dirt contained in the air is filtered out, while the air passes through the dust filter (not shown), which is located in the dust collecting chamber. The air is discharged back into the environment via the motor driving chamber. In FIG. 1, reference numeral 4 represents wheels to facilitate movement of the vacuum cleaner. The wheels 4 are located on both sides of the brush assembly 3.

Meanwhile, the brush assembly 3, as shown in FIG. 2, includes a brush cover 11, a brush base 12 connected to the lower side of the brush cover 11 by a plurality of set screws 12*a*, and a rotary drum 13 rotatably disposed between the brush cover 11 and the brush base 12. The rotary drum 13 brushes off dust on the cleaning surface to facilitate suction of the dust during the cleaning process. The brush assembly further includes a pair of edge brushes 14 and 14' connected to the sides of the brush base 12 by set screws 14*a*. The edge brushes 14 and 14' brush off dust on the cleaning surface that is located at the sides of the brush assembly 3 and not brushed off by the rotary drum 13. A bumper 15 is mounted on a joint surface between the brush cover 11 and the brush base 12. The bumper 15 seals the joint surface and also protects the brush assembly 3, in case the brush assembly 3 collides with any external object.

Albeit not shown, the brush assembly 3 includes a motor for rotatably driving the rotary drum 13. The motor and the rotary drum 13 are connected by a belt (not shown) in a manner such that the rotary drum 13 is rotatably driven by the motor. The rotary drum 13 cannot brush off dust in certain areas of the cleaning surface corresponding to the sides of the rotary drum 13. The pair of edge brushes 14 and 14' that are located on both sides of the brush base 12, however, come into contact with these areas of the cleaning surface to brush off the dust and enable it to be drawn into the brush assembly 3 of the vacuum cleaner.

One problem with a conventional vacuum cleaner brush assembly is the number of individual pieces, such as a pair of edge brushes 14 and 14', that must be assembled together. Shortcomings associated with the large number of pieces of the brush assembly include a longer assembly time and low productivity.

More specifically, the brush assembly is assembled in such a manner that the edge brushes 14 and 14' are fastened onto both sides of the brush base 12 by the set screws 14*a*, and the brush base 12 is fastened onto the brush cover 11 by a plurality of set screws 12*a*. The bumper 15, which is made of a plastic material, is insert-connected on the joint surface between the brush cover 11 and the brush base 12. The numerous assembly steps involved creates assembling difficulties and lengthens the assembling time.

Furthermore, since the conventional edge brushes 14 and 14' are provided as separate parts, they require a separate injection mold process to mold the edge brushes 14 and 14', thereby increasing costs. Moreover, the additional processes for molding and assembling the edge brushes 14 and 14' decreases the overall productivity of manufacturing the brush assembly.

SUMMARY OF THE INVENTION

The present invention has been made to overcome the above-mentioned problems of the related art. Accordingly, it is an object of the present invention to provide a brush assembly for a vacuum cleaner that is easier and quicker to assemble. The brush assembly of the present invention has an improved connecting structure for an edge brush and fewer individual parts.

The above object is accomplished by providing a vacuum cleaner brush assembly that includes a brush cover, a brush base connected to the lower surface of the brush cover, a rotary drum, and an edge brush integrated bumper. The rotary drum is disposed between the brush cover and the brush base and rotates to brush off dust on a cleaning surface, thereby facilitating suction of the dust into the brush assembly. The edge brush integrated bumper is mounted on a joint surface between the brush cover and the brush base to seal the joint surface. The edge brush integrated bumper also protects the brush cover and/or an external object, in the event that the vacuum cleaner brush assembly collides with the external object. The edge brush integrated bumper includes a pair of edge brush portions that are integrally formed. The edge brush portions are located at the sides of the brush cover and brush off dust on certain areas of the cleaning surface that are not accessible by the rotary drum.

The edge brush integrated bumper is injection molded using a soft synthetic resin so as to perform a buffering action.

Further, the vacuum cleaner brush assembly of the present invention includes an assembling position guide portion for guiding the edge brush integrated bumper to a precise location of the brush cover and a fixing portion for maintaining the assembled status of the edge brush-integrated bumper.

The assembling position guide portion includes a pair of position guide depressions that are formed in the inner sides of the edge brush portions of the edge brush integrated bumper and a pair of position guide elevations that protrude from the outer surfaces of the sides of the brush cover. The pair of position guide elevations correspond to the pair of position guiding depressions.

The fixing portion includes a pair of fixing bosses having throat parts vertically extending from both ends of the edge brush integrated bumper and a pair of fixing slots having cutaway parts. The pair of fixing slots are formed in both sides of the brush cover and correspond to and receive the pair of fixing bosses.

Since the edge brushes are integrally formed with the bumper by a single injection molding process, the number of parts is reduced, thereby simplifying assembly of the brush assembly. Accordingly, assembly time is decreased and productivity is increased.

BRIEF DESCRIPTION OF THE DRAWINGS

The above objects and other features and advantages of the present invention will become more apparent after a reading of the following detailed description when taken in conjunction with the drawings, in which.

DETAILED DESCRIPTION OF THE PREFERRED EMBODIMENT

Figure 1:
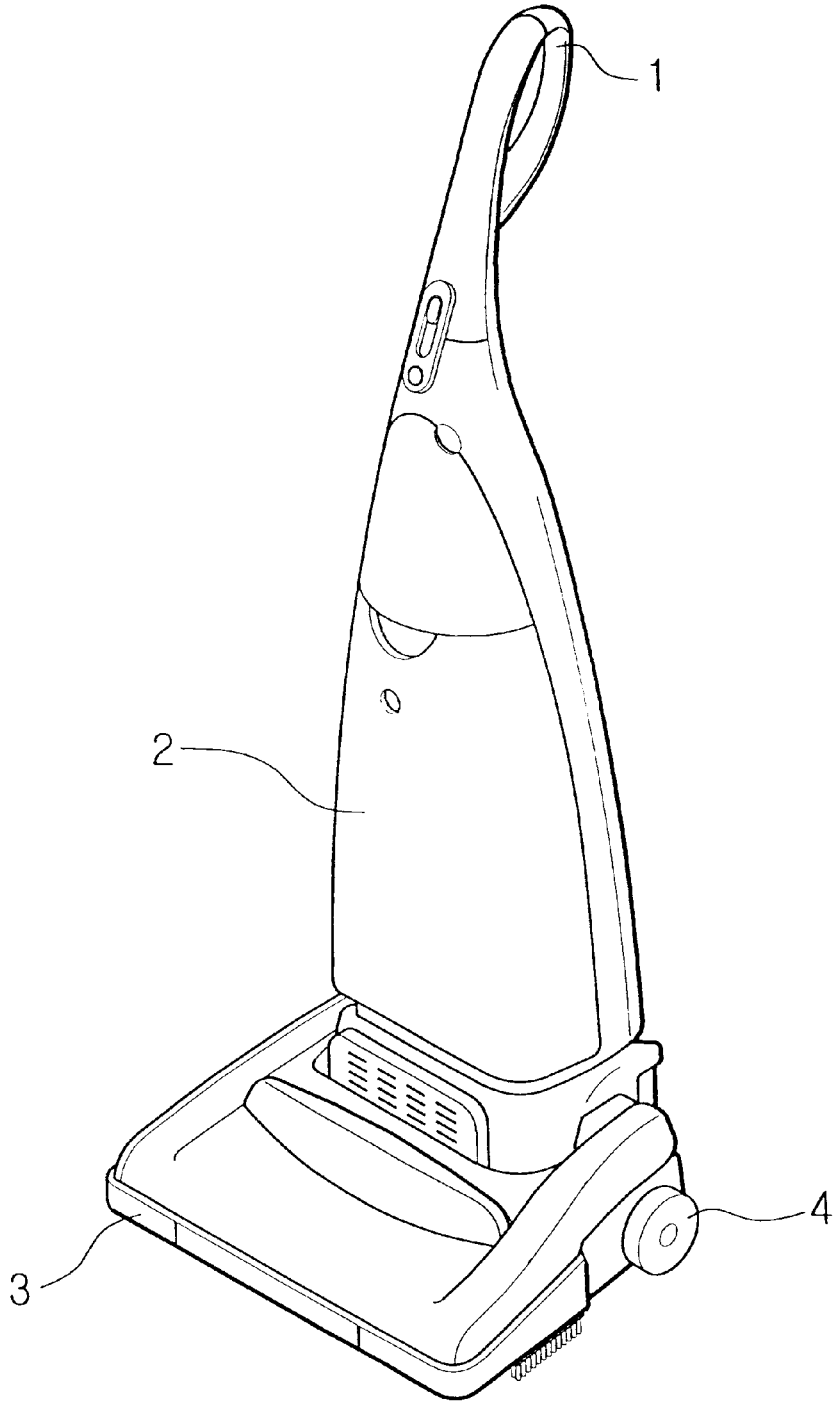
FIG. 1 (PRIOR ART)
FIG. 1 is a perspective view of a conventional upright type vacuum cleaner including a brush assembly.
Figure 2:
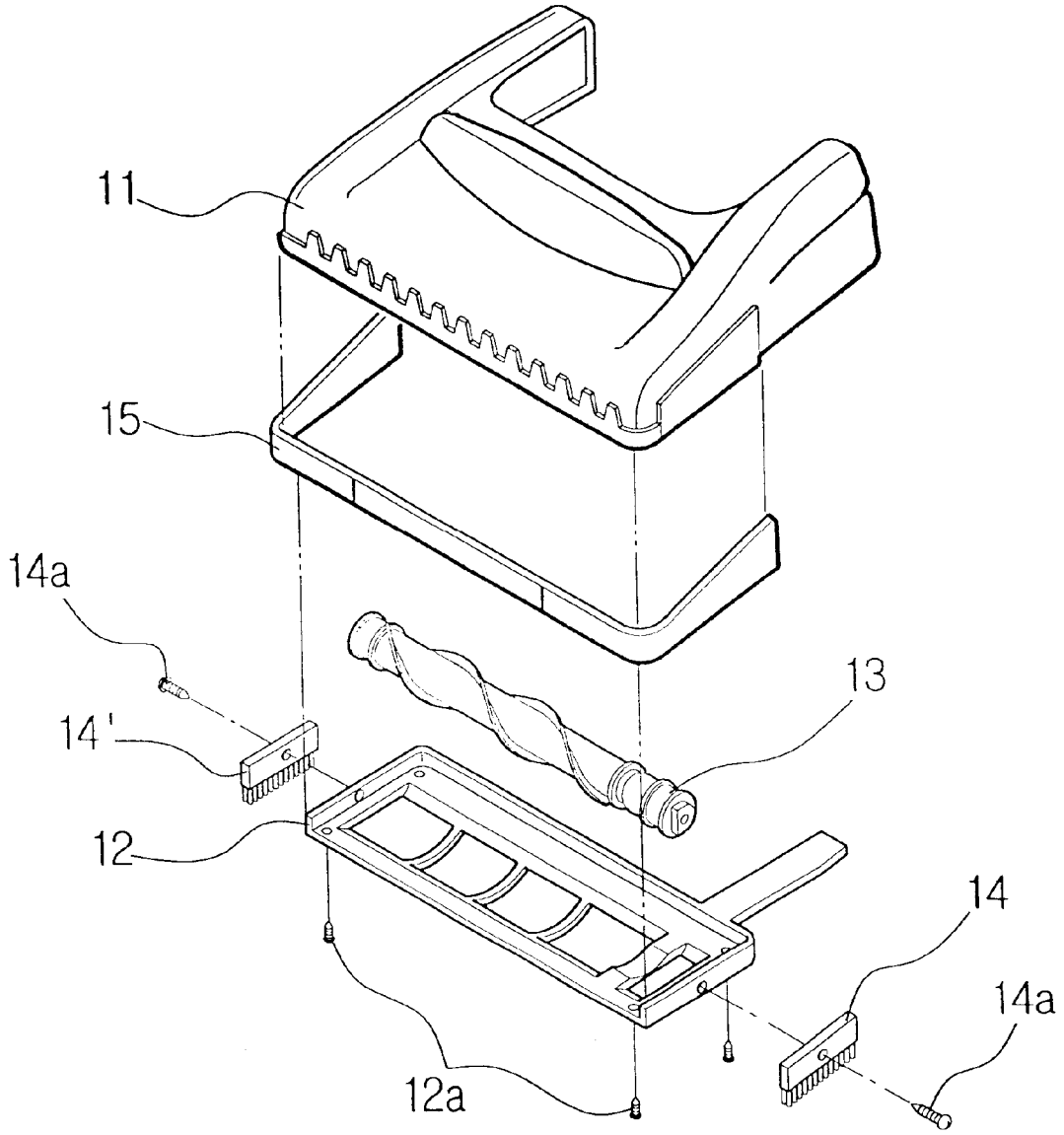
FIG.2 (PRIOR ART)
FIG. 2 is an exploded perspective view of the brush assembly for the conventional vacuum cleaner shown in FIG. 1.
Figure 3:
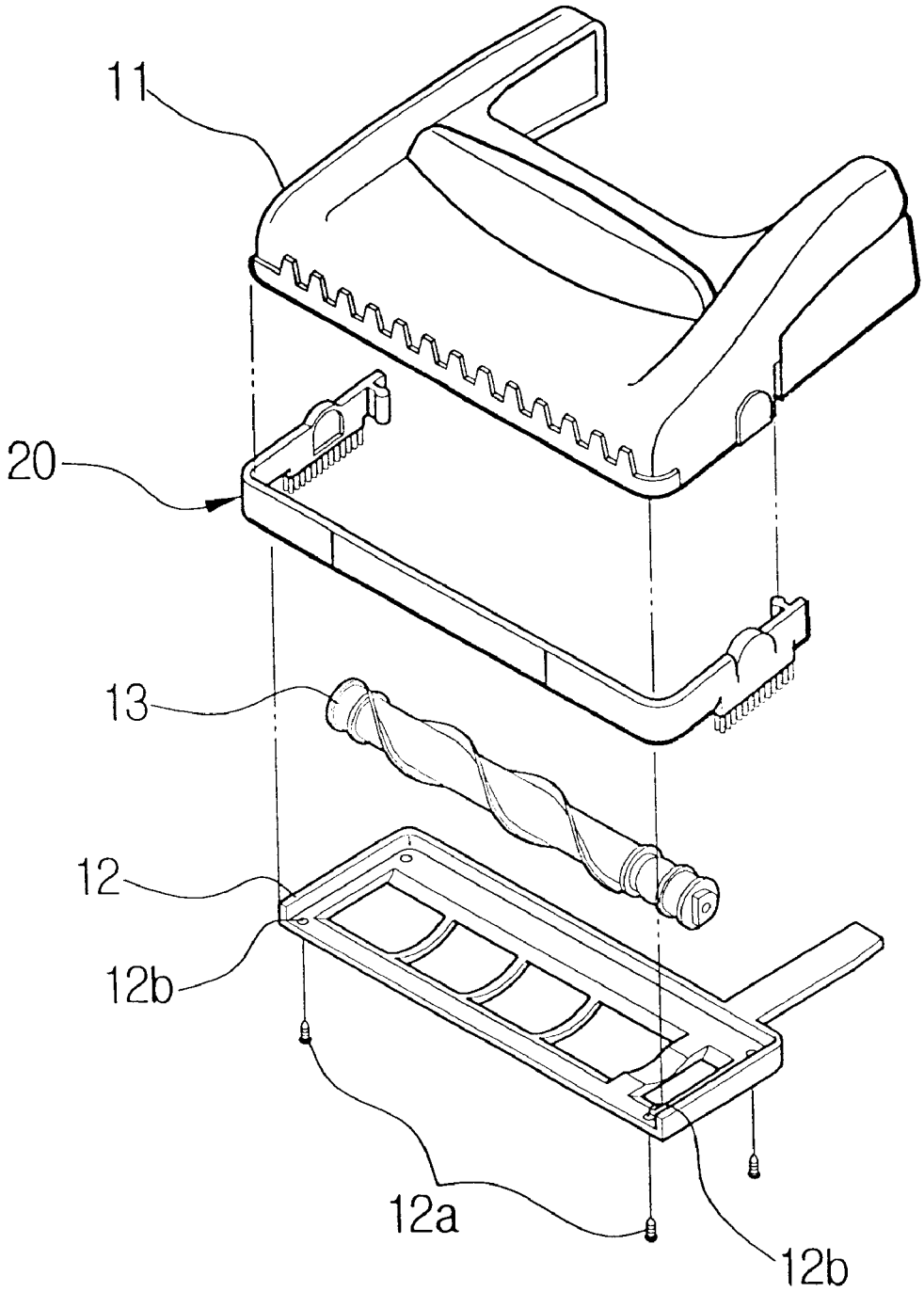
FIG. 3 is an exploded perspective view of a vacuum cleaner brush assembly in accordance with a preferred embodiment of the present invention.
Figure 4:
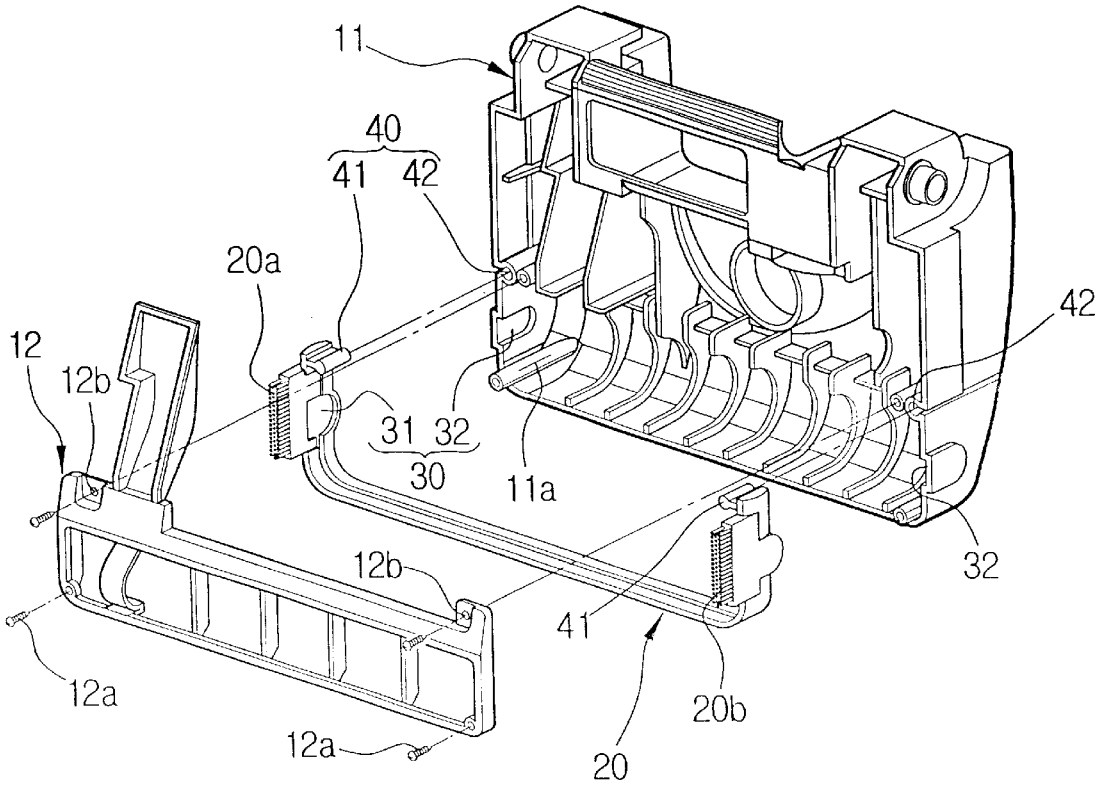
FIG. 4 is an exploded perspective bottom view of the brush assembly of FIG. 3, showing the connecting structure of the edge brush integrated bumper.
Figure 5:
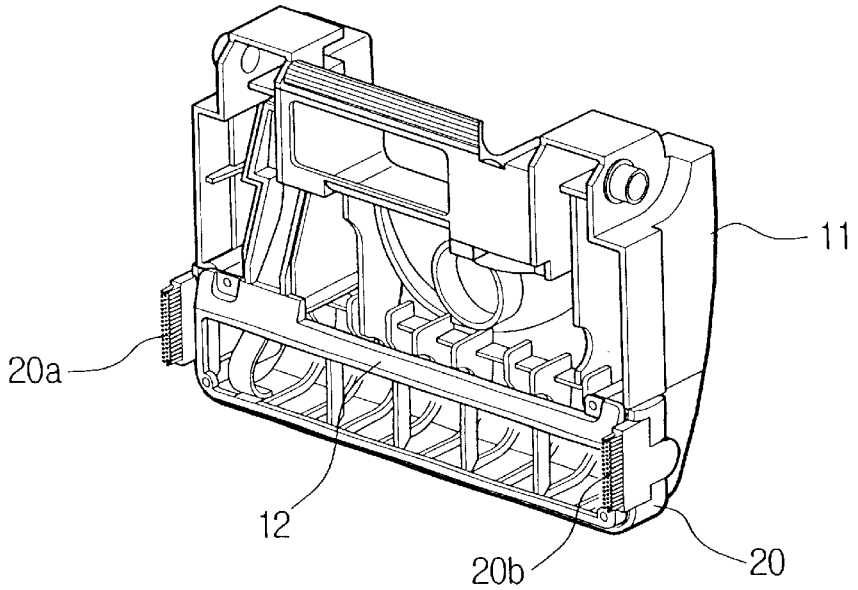
FIG. 5 is a perspective bottom view of the brush assembly of FIGS. 3 and 4 in an assembled state.

FIGS. 3 to 5 illustrate a brush assembly for a vacuum cleaner in accordance with a preferred embodiment of the present invention. Wherever possible, the same reference numerals will be used throughout the drawings and the description to refer to the same or like parts.

As shown in FIG. 3, the vacuum cleaner brush assembly of the present invention includes a brush cover 11, a brush base 12, rotary drum 13, and an edge brush-integrated bumper 20.

As shown in FIGS. 4 and 5, the brush cover 11 has four fixing bosses 11*a* that protrude from the brush cover 11, while the brush base 12 has four screw holes 12*b* that are formed in the brush base 12 and correspond to the fixing bosses 11*a* of the brush cover 11. The brush base 12 is connected to the lower side of the brush cover 11 by a plurality of set screws 12*a*, which are fastened to the fixing bosses 11*a* of the brush cover 11 after passing through the screw holes 12*b* of the brush base 12.

The rotary drum 13 is located between the brush cover 11 and the brush base 12. A motor (not shown), which is coupled to the rotary drum 13, rotates the rotary drum 13 to brush off dust on the cleaning surfaces, thereby facilitating suction of dust into the vacuum cleaner.

The edge brush integrated bumper 20 is located on a joint surface between the brush cover 11 and the brush base 12 and seals the joint surface. The edge brush integrated bumper also protects the brush cover and any external object by buffering the shock when the brush assembly collides with the external object as a result of movement of the brush assembly. Further, the edge brush integrated bumper 20 includes a pair of edge brush portions 20*a* and 20*b* that are integrally formed on the edge brush integrated bumper 20. The edge brush portions 20*a* and 20*b* correspond to opposing sides of the brush cover 11. When the edge brush integrated bumper 20 is mounted on the brush cover 11, the edge brush portions 20*a* and 20*b* brush off dust on the sides of the brush cover 11, which dust is not readily accessible to the rotary drum 13.

The edge brush integrated bumper 20 described above is preferably injection molded using a soft plastic material. Unlike the conventional separately formed edge brushes and bumper, according to the present invention the bumper and edge brush are integrally formed. Accordingly, since a single mold is used to create the edge brush integrated bumper 20, material and assembly costs are reduced. In addition, the number of processes required to assemble the brush assembly is also reduced due to the fewer number of parts. As a result, productivity is increased.

Meanwhile, the vacuum cleaner brush assembly of the present invention has such a structure that facilitates assembly of the edge brush integrated bumper 20 to the brush cover 11, including an assembling position guide portion 30 and a fixing portion 40 as shown in FIGS. 4 and 5.

The assembling position guide portion 30 guides the edge brush integrated bumper 20 to the precise location with respect to the brush cover 11 and facilitates the assembly process. The assembling position guide portion 30 includes a pair of position guide depressions 31, each of which is formed in the inner side of a respective edge brush portion 20*a*, 20*b* of the edge brush integrated bumper 20. The assembling position guide portion 30 further includes a pair of position guide elevations 32 that protrude from the outer sides of the brush cover 11 and corresponding to the pair of position guide depressions 31.

The fixing portion 40 affixes the edge brush integrated bumper 20 to the brush cover 11. The fixing portion includes a pair of fixing bosses 41 and a pair of fixing slots 42. The fixing bosses 41 are located on opposing sides of the edge brush integrated bumper 20, and each fixing boss 41 has a throat portion that extends vertically from the edge brush integrated bumper 20. The pair of fixing slots 42 are formed on the sides of the brush cover 11 and have cutaway portions that correspond to the fixing bosses 41. The fixing bosses 41 and fixing slots 42 matingly engage to secure the edge brush integrated bumper 20 to the brush cover 11.

The vacuum cleaner brush assembly of the present invention is assembled as follows. First, the edge brush integrated bumper 20 is mounted to the joint surface between the brush cover 11 and brush base 12. Next, the rotary drum 13 is positioned between the brush base and the brush cover. The brush base 12 is then fastened to the lower side of the brush cover 11 with the plurality of set screws 12*a*. At this time, the position guide depressions 31, which are formed on the sides of the edge brush integrated bumper 20, are inserted into the position guide elevations 32 of the brush cover 11. As the position guide depressions 31 are inserted into the position guide elevations 32, the fixing bosses 41 of the edge brush integrated bumper 20 are also inserted into the fixing slots 42 of the brush cover to fixedly secure the edge brush integrated bumper 20 to the brush cover 11.

As described above, in the vacuum cleaner brush assembly of the present invention, the bumper and edge brushes are integrally formed with each other, thereby reducing the number of parts. This reduction in the number of parts also reduces the cost of the brush assembly and improves assembly time and productivity.

Further, in the vacuum cleaner brush assembly of the present invention, since the edge brush integrated bumper 20 is attached to the brush cover 11 without additional fasteners, such as screws, etc., and since the bumper and edge brushes are assembled in a single process, productivity is improved by the reduction of processes.

One embodiment of the invention has been disclosed in the drawings and specification. Although specific terms are employed, they are used in a generic and descriptive sense only and not for purposes of limitation. The scope of the invention is set forth in the following claims. Various changes and modifications can be made by one skilled in the art within the spirit and scope of the present invention as hereinafter claimed.

What is claimed is:

1. A brush assembly for a vacuum cleaner comprising:

a cover;

a base connected to a lower surface of the cover;

a rotary drum rotatably disposed between the cover and the base, the rotary drum brushing off dust on a cleaning surface to facilitate suction of the dust from the cleaning surface into the vacuum cleaner; and an edge brush integrated bumper mounted around a joint surface between the cover and the base, the bumper sealing the joint surface and protecting the cover and an external object when the brush assembly collides with the external object, the bumper having a pair of edge brush portions integrally formed with the bumper, each edge brush portion being located at a side of the cover, the edge brush portions brushing off dust on the cleaning surface that is not accessible to the rotary drum.

2. The brush assembly as claimed in claim 1, wherein the edge brush integrated bumper is injection molded using a synthetic resin, the synthetic resin of the bumper acting as a buffer between the cover and the external object.

3. The brush assembly as claimed in claim 1, further comprising:

assembling position guide means for guiding the edge brush integrated bumper to a precise location of the cover; and fixing means for securing the edge brush integrated bumper to the cover.

4. The brush assembly as claimed in claim 3, wherein the assembling position guide means comprises:

a pair of position guide depressions formed in the edge brush portions of the edge brush integrated bumper; and a pair of position guide elevations protruding from the sides of the cover, each position guide elevation corresponding with a respective position guide depression.

5. The brush assembly as claimed in claim 4, wherein each position guide depression is formed in an inner side of the respective edge brush portion; and wherein each position guide elevation protrudes from an outer surface of the respective side of the cover.

6. The brush assembly as claimed in claim 3, wherein the fixing means comprises:

a pair of fixing bosses located on the edge brush integrated bumper, each fixing boss having a vertically extending throat part; and a pair of fixing slots formed in the side of the cover, each fixing slot having a cutaway part for receiving a respective fixing boss.

7. A brush assembly for a vacuum cleaner comprising:

a cover;

a base coupled to the cover;

a rotary drum disposed between the cover and the base, the rotary drum rotating to brush off dust on a cleaning surface and facilitating suction of the dust into the vacuum cleaner; and a bumper mounted around a joint surface between the cover and the base, the bumper including a plurality of edge brush portions integrally formed in the bumper, each edge brush portion being located at a side of the cover, wherein the bumper is press fit into assembly with the cover.

8. The brush assembly as claimed in claim 7, wherein the bumper is injection molded using a synthetic resin.

9. The brush assembly as claimed in claim 7, further comprising:

assembly position guide means for guiding the bumper into position with the cover; and fixing means for securing the bumper to the cover.

10. The brush assembly as claimed in claim 9, wherein the assembly position guide means comprises:

a plurality of guide depressions formed in the bumper; and a plurality of position guide elevations extending from the cover, each position guide elevation corresponding with a respective guide depression.

11. The brush assembly as claimed in claim 10, wherein each guide depression is located on a respective edge brush portion of the bumper.

12. The brush assembly as claimed in claim 9, wherein the fixing means comprises:

a plurality of fixing bosses on the bumper; and a plurality of fixing slots formed in the sides of the cover, each fixing slot corresponding to and receiving a respective fixing boss.

* * * * *